United States Patent [19]

Ragland, Jr.

[11] Patent Number: 5,012,154

[45] Date of Patent: Apr. 30, 1991

[54] COLOR PICTURE TUBE HAVING IMPROVED SHADOW MASK-FRAME ASSEMBLY SUPPORT

[75] Inventor: Frank R. Ragland, Jr., Lancaster, Pa.

[73] Assignee: RCA Licensing Corporation, Princeton, N.J.

[21] Appl. No.: 444,215

[22] Filed: Dec. 1, 1989

[51] Int. Cl.[5] ..... H01J 29/07

[52] U.S. Cl. ..... 313/406; 313/404

[58] Field of Search ..... 313/404, 405, 406

[56] References Cited

U.S. PATENT DOCUMENTS

| | | | |
|---|---|---|---|
| 3,529,199 | 9/1970 | Duistermaat et al. | 313/85 |
| 4,317,064 | 2/1982 | Dougherty | 313/406 |
| 4,467,242 | 8/1984 | Wilbur, Jr. et al. | 313/406 |
| 4,572,983 | 2/1986 | Ragland, Jr. | 313/406 X |
| 4,613,785 | 9/1986 | Ragland, Jr. | 313/405 |
| 4,723,088 | 2/1988 | Sone et al. | 313/404 |
| 4,728,853 | 3/1988 | Sone et al. | 313/406 |
| 4,827,180 | 5/1989 | Sone et al. | 313/404 |

*Primary Examiner*—Sandra L. O'Shea

*Attorney, Agent, or Firm*—Joseph S. Tripoli; Dennis H. Irlbeck

[57] ABSTRACT

An improved color picture tube includes an evacuated glass envelope having a rectangular faceplate panel. The panel includes a shadow mask assembly mounted therein by support means located at peripherally spaced positions within the panel. The support means at each of the spaced positions includes a stud, attached to the glass envelope, and a spring, having an aperture therein that engages the stud. The spring is interconnected with the shadow mask assembly. The improvement comprises the spring including a first portion interconnected with the shadow mask assembly, an elongated second portion extending from the first portion toward the stud, a third portion interconnected with the second portion and including an aperture engaging the stud, and an offset section that positions the center of the aperture on a central longitudinal plane passing through the second portion.

10 Claims, 2 Drawing Sheets

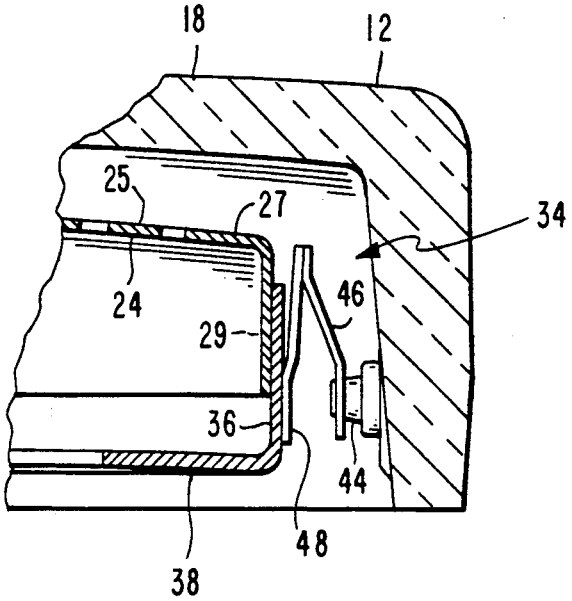
FIG. 3
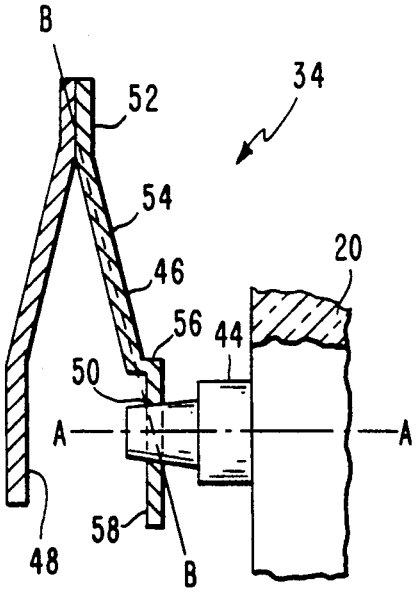
FIG. 4
FIG. 5 PRIOR ART
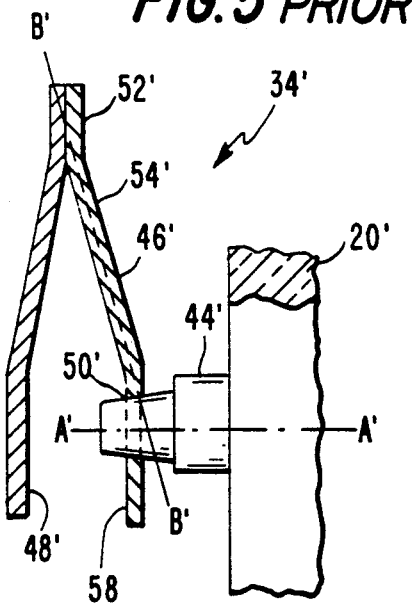
FIG. 6
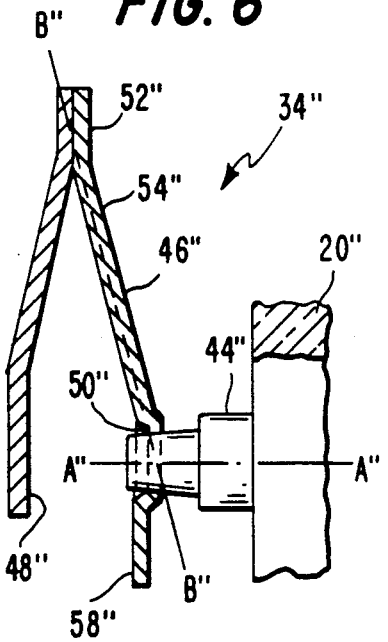

COLOR PICTURE TUBE HAVING IMPROVED SHADOW MASK-FRAME ASSEMBLY SUPPORT

This invention relates to color picture tubes of the type having a shadow mask attached to a peripheral frame which is suspended in relation to a cathodoluminescent screen and, particularly, to improved means for suspending a mask-frame assembly in such a tube.

BACKGROUND OF THE INVENTION

In most current color picture tube types, a peripheral frame supporting a shadow mask is suspended in a faceplate panel by means of springs that are welded either directly to the frame or to plates which in turn are welded to the frame. In the directly welded version, the springs are usually made of bimetallic materials; and in the plate version, the plates are bimetallic. As the springs or plates become heated by transfer of heat from the mask through the frame, the bimetallic materials expand differently, thereby bending the springs or plates to cause movement of the mask-frame assembly toward a screen disposed on the panel.

It is common to use either three or four springs to support a mask-frame assembly within a rectangular faceplate panel of a tube. In a three-spring support system, one spring is usually located at the upper center of the mask, and the other two springs are located along the sides of the tube between the centers of the sides of the mask and the lower two corners of the mask. In a four-spring support system, springs are usually located at the top and bottom centers of the mask and at the left and right centers of the mask. In both the three- and four-spring support systems, as described above, it is possible for the mask-frame assembly to twist slightly and shift relative to the faceplate, during tube manufacture and/or operation.

A known means for minimizing twisting and shifting of a mask-frame assembly uses spring supports at the four corners of the frame. Embodiments for achieving such corner support are shown in U.S. Pat. No. 4,723,088, issued to Sone et al. on Feb. 2, 1988, and in U.S. Pat. No. 4,728,853, issued to Sone et al. on Mar. 1, 1988.

U.S Pat. No. 4,723,088 shows a mask frame having truncated corners with supports at each corner. The supports are bent plates including three sections. A first section is welded to the frame. A second section extends at an angle from the first section toward a skirt of a faceplate panel. A third section extends from the second section and includes an aperture that engages a metal stud embedded in the panel sidewall.

U.S Pat. No. 4,728,853 discloses a mask-frame assembly support which includes two members welded together. One member, having a flat plate shape, is welded at several separated points to a mask frame. The second member includes three sections. A first section is welded to the first member. A second section angles from the first section, and an apertured third section engages a support stud in the panel sidewall.

A problem encountered with many prior art support systems is that they may shift when subjected to shock and vibration. Therefore, there is a need for improvements in mask support systems that will reduce their susceptibility to such shifts.

The present invention provides an improvement in tubes, using the mask-frame assembly support systems of the above-identified patents, that is less affected by shock and vibration.

SUMMARY OF THE INVENTION

The improved color picture tube includes an evacuated glass envelope having a rectangular faceplate panel. The panel includes a shadow mask assembly mounted therein by support means located at peripherally spaced positions within the panel. The support means at each of the spaced positions includes a stud attached to the glass envelope and a spring having an aperture therein that engages the stud. The spring is interconnected to the shadow mask assembly. The improvement comprises the spring including a first portion interconnected with the shadow mask assembly, an elongated second portion extending from the first portion toward the stud, a third portion interconnected with the second portion and including an aperture engaging the stud, and an offset section that positions the center of the aperture on a central longitudinal plane passing through the second portion.

BRIEF DESCRIPTION OF THE DRAWINGS

FIG. 3 is a partial sectional view of a corner of the faceplate panel and mask-frame assembly of FIG. 2.

FIG. 4 is a plan view of a spring, plate and stud in accordance with the present invention.

FIG. 5 is a plan view of a prior art spring, plate and stud.

FIG. 6 is a plan view of a spring, plate and stud of another embodiment of the present invention.

DETAILED DESCRIPTION OF THE PREFERRED EMBODIMENTS

Figure 1:
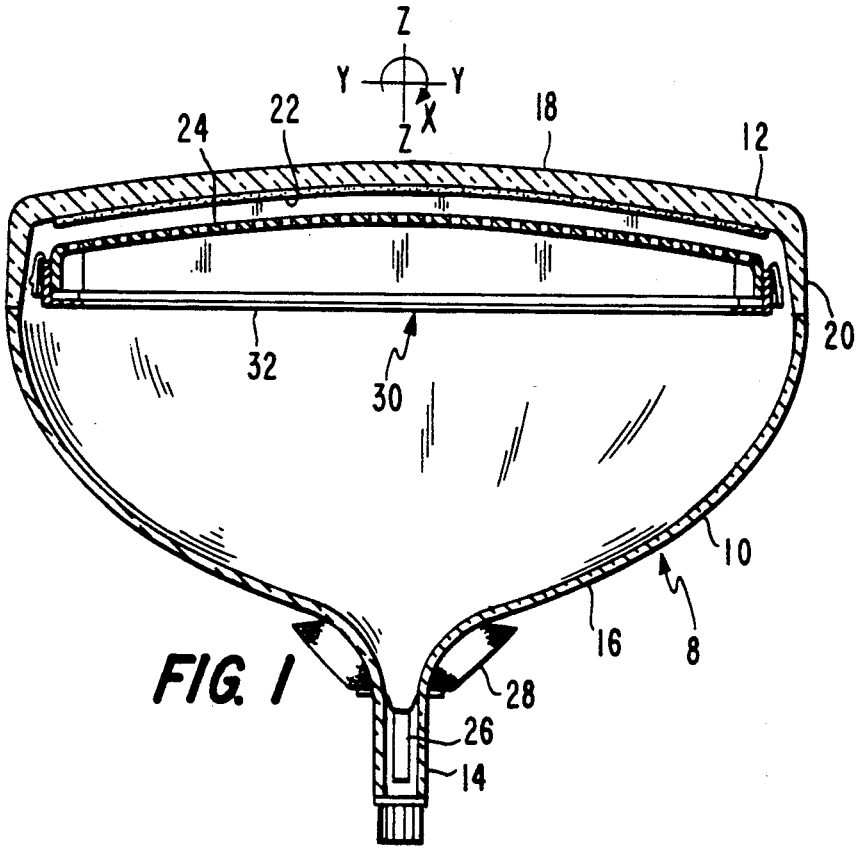
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and a peripheral flange or sidewall 20 which is sealed to the funnel 16. The faceplate panel 12 includes two orthogonal axes: a major axis X—X, parallel to its wider dimension (usually horizontal), and a minor axis Y—Y, parallel to its narrower dimension (usually vertical). The major and minor axes are perpendicular to the central longitudinal axis Z—Z of the tube which passes through the center of the neck 14 and the center of the panel 12. A mosaic three-color phosphor screen 22 is carried by the inner surface of the faceplate 18. The screen preferably is a line screen with the phosphor lines extending substantially parallel to the minor axis Y—Y. Alternatively, the screen may be a dot screen. A multiapertured color selection electrode or shadow mask 24 is removably mounted, by improved means, in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke, such as the yoke 28, located in the vicinity of the funnel-to-neck junction. When activated, the yoke 28 subjects the three beams to magnetic fields which cause the beams to scan horizontally and vertically in a rectangular raster over the screen 22.

Figure 2:
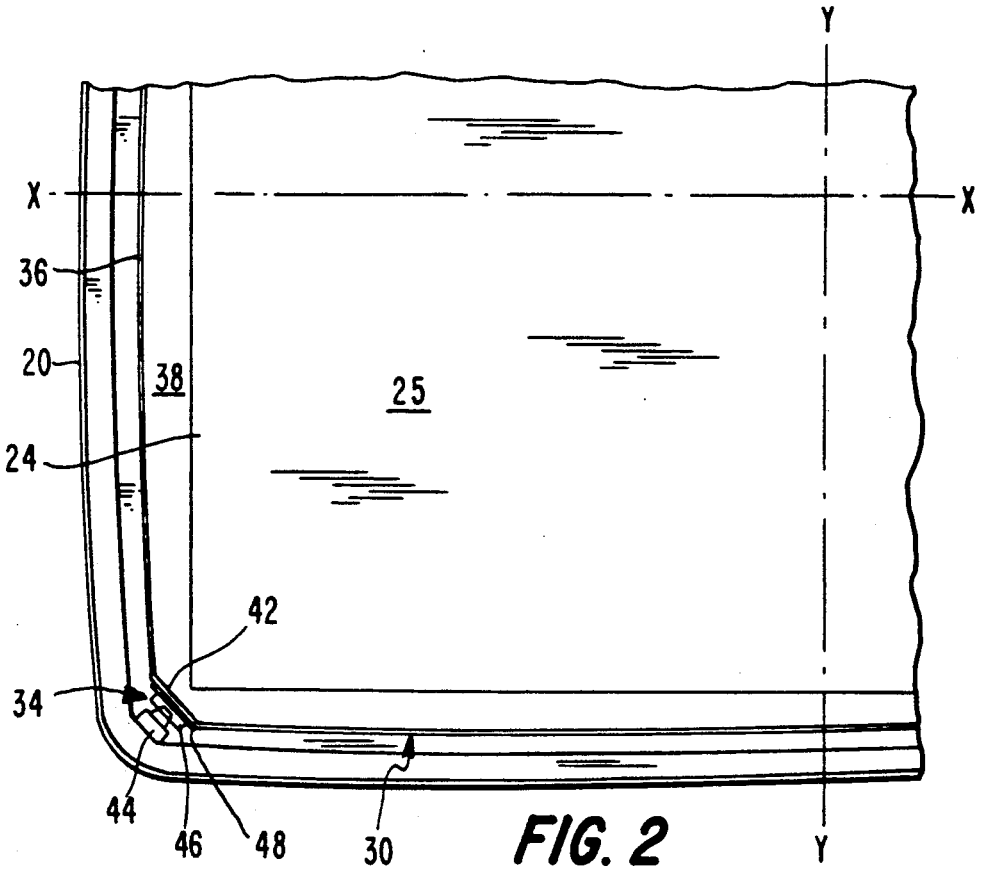
FIG. 2 is a bottom view of a quadrant of the faceplate panel and mask-frame assembly of the tube of FIG. 1.

The shadow mask 24 is part of a mask-frame assembly 30 that also includes a peripheral frame 32. The mask-frame assembly 30 is shown positioned within the face-plate panel 12 in FIGS. 1, 2 and 3. The mask-frame assembly 30 is mounted to the panel 12 by four improved support means 34 shown in FIGS. 2, 3 and 4.

The frame 32 includes two substantially perpendicular flanges, a first flange 36 and a second flange 38, in an L-shaped cross-sectional configuration. The first flange 36 extends from the second flange 38 in a direction toward the screen 22. The second flange 38 extends from the first flange 36 in a direction toward the central longitudinal axis Z—Z of the tube 8. The four corners 42 of the frame 32 are truncated, being angled approximately perpendicularly to the diagonal directions of the frame.

The shadow mask 24 includes a curved apertured portion 25, an imperforate border portion 27 surrounding the apertured portion 25, and a skirt portion 29 bent back from the border portion 27 and extending away from the screen 22. The mask 24 is telecoped within or set inside the frame 32 and welded to the inside surface of the first flange 36.

Mask-frame assembly support means 34 are included at each of the four corners of the frame and panel. Each support means 34 includes a stud 44, a spring 46 and a plate 48. Each stud 44 is a conically-shaped metal member that is attached to the panel sidewall 20. Each plate 48 is welded near one end to the flange 36 at a truncated corner 42 of the frame 32. The spring 46 is attached at one of its ends to the other end of the plate 48. An aperture 50, near the free end of each spring 46, engages the conical tip of a stud 44.

The spring 46 includes a first portion 52 that parallels the plate 48 and is welded thereto. An elongated second portion 54 extends from the first portion 52 an forms an acute angle with the plate 48. An offset section 56 extends from the second portion 54 in a direction away from the plate 48 so that it approximately parallels the central longitudinal axis A—A of the stud 44. A third portion 58 extends from the offset section 56 and is approximately perpendicular to the central longitudinal axis A—A of the stud 44. The third portion 58 includes the aperture 50 that engages the conical tip of the stud 44. The elongated second portion 54 is aligned with the center of the aperture 50, so that a central longitudinal plane B—B of the second portion 54 crosses the central longitudinal axis A—A of the stud 44 approximately at the center of the aperture 50.

For comparison, a prior art mask-frame assembly support means 34′ is shown in FIG. 5. In FIG. 5, components similar to those in FIG. 4 are labelled with primes of the same numbers. In the spring 46′ of the support means 34′, an elongated center portion 54′ extends between one portion 52′, that is welded to a plate 48′, and another portion 58′, that includes an aperture 50′ which engages a stud 44′. The elongated portion 54′ is not aligned with the center of the aperture 50′, but rather has its central longitudinal axis B′—B′ crossing the central longitudinal axis A′—A′ of the stud 44′ between the aperture 50′ and the panel sidewall 20′.

Another embodiment of a mask-frame assembly support means 34″ in accordance with the present invention is shown in FIG. 6. In FIG. 6, components that are similar to those in FIG. 4 are labelled with double primes of the same numbers. Like the support means 34, each support means 34″ includes a stud 44″, a spring 46″ and a plate 48″. The spring 46″ includes three portions 52″, 54″ and 58″. A first portion 52″ parallels the plate 48″ and is welded thereto. A second portion 54″ extends from the first portion 52″ and forms an acute angle with the plate 48″. A third portion 58″ extends from the second portion 54″ and is approximately perpendicular to the central longitudinal axis A—A of the stud 44″. The third portion 58″ has a circular embossed section 60 that includes a centered aperture 50″. In this embodiment, the embossed section 60 provides the same offset as does the third portion 56 of the spring 46 of the support means 34. Because of the offset, the elongated second portion 54″ is aligned with the center of the aperture 50″, so that a central longitudinal plane B″—B″ of the second portion 54″ crosses the central longitudinal axis A″—A″ of the stud 44″ approximately at the center of the aperture 50″.

It has been found that the distance between the center of the aperture 50′ and the central longitudinal plane passing through the second portion 54′ of the prior art support means 34′ provides a lever arm within the support means 34′ When the support means 34′ is stressed, this lever arm can cause bending of the second portion 54′, thereby causing undesirable shifts of the support means and shadow mask assembly. By aligning the center of the aperture 50 or 50″ with the central longitudinal plane B—B or B″—B″, the lever arm is eliminated, and any stresses parallel to the second portions 54 or 54″ will not cause a bending of the springs 46 or 46″.

Although the present invention has been described with respect to a tube having a corner-mounted shadow mask therein, it should be understood that the invention may alternatively be applied to a tube having a shadow mask mounted along the major and minor axes within a tube faceplate panel. Furthermore, the present invention may be applied to a tube in which peripheral reinforcement of a shadow mask is provided integrally with the mask, without use of a separate frame. In addition, the present invention may be applied to a mask support system having other than four support locations.

What is claimed is:

1. In a color picture tube including an evacuated glass envelope having a rectangular faceplate panel, said panel including a shadow mask assembly mounted therein by support means located at peripherally spaced positions within said panel, said support means at each of said spaced positions including a stud attached to said glass envelope, and a spring interconnected with said shadow mask assembly, said spring having an aperture therein engaging said stud, the improvement comprising said spring including a first portion interconnected with said shadow mask assembly, an elongated second portion extending from said first portion toward said stud, a third portion interconnected with said second portion and including an aperture engaging said stud, and an offset section that positions the center of said aperture on a central longitudinal plane of said second portion.

2. The tube as defined in claim 1, wherein said offset portion is located between said second portion and said third portion.

3. The tube as defined in claim 1, wherein said offset portion is an embossment in said third portion surrounding said aperture.

4. In a color picture tube including an evacuated glass envelope having a rectangular faceplate panel, said panel including a shadow mask assembly mounted therein by support means located at peripherally spaced positions within said panel, said support means at each of said spaced positions including a stud attached to said glass envelope, and a spring interconnected with said shadow mask assembly, said spring having an aperture therein engaging said stud, the improvement comprising said spring including a first portion interconnected with said shadow mask assembly, an elongated second portion extending from said first portion toward said stud, a third portion interconnected with said second portion and including an aperture engaging said stud, and an offset section between said second portion and said aperture to align said aperture with a central longitudinal plane passing through said second portion.

5. The tube as defined in claim 4, wherein said offset section is located between said second portion and said third portion.

6. The tube as defined in claim 4, wherein said offset section is an embossment in said third portion surrounding said aperture.

7. In a color picture tube including an evacuated glass envelope having a rectangular faceplate panel, said panel including a shadow mask assembly mounted therein by support means located at peripherally spaced positions within said panel, said support means at each of said spaced positions including a stud attached to said glass envelope, and a spring interconnected with said shadow mask assembly, said spring having an aperture therein engaging said stud, the improvement comprising said spring including a first portion interconnected with said shadow mask assembly, an elongated second portion extending from said first portion toward said stud, an offset section extending from said second portion and approximately paralleling a longitudinal axis of said stud, and a third portion extending from said offset section and being approximately perpendicular to said offset section, said third portion having said aperture therein engaging said stud, and said elongated second portion being longitudinally aligned with the center of said aperture.

8. In a color picture tube including an evacuated glass envelope having a rectangular faceplate panel, said panel including a shadow mask welded to a peripheral frame mounted therein by support means located at four peripherally spaced positions within said panel, said support means at each of said four positions including a stud attached to said glass envelope, a spring and a plate, said spring being welded to said plate and having an aperture therein engaging said stud, and said plate being welded to said frame, the improvement comprising said spring including a first portion being welded to said plate, an elongated second portion extending from said first portion and forming an acute angle with said plate, an offset section extending from said second portion in a direction away from said plate, and a third portion extending from said offset section, said third portion having said aperture therein engaging said stud, and wherein said elongated second portion being aligned with the center of said aperture.

9. In a color picture tube including an evacuated glass envelope having a rectangular faceplate panel, said panel including a shadow mask assembly mounted therein by support means located at peripherally spaced positions within said panel, said support means at each of said spaced positions including a stud attached to said glass envelope and a spring interconnected with said shadow mask assembly, said spring having an aperture therein engaging said stud, the improvement comprising said spring including a first portion interconnected with said shadow mask assembly, an elongated second portion extending from said first portion toward said stud, and a third portion extending from said second portion, said third portion having an embossed section offsetting a part of the third portion from the remainder of the third portion, the offset part of the third portion including an aperture engaging said stud, and the center of said aperture being on a plane passing through said second portion.

10. In a color picture tube including an evacuated glass envelope having a rectangular faceplate panel, said panel including a shadow mask welded to a peripheral frame mounted therein by support means located at four peripherally spaced positions within said panel, said support means at each of said four positions including a stud attached to said glass envelope, a spring and a plate, said spring being welded to said plate and having an aperture therein engaging said stud, and said plate being welded to said frame, the improvement comprising said spring including a first portion attached to said plate, an elongated second portion extending from said first portion toward said stud, and a third portion extending from said second portion, said third portion having an embossed section offsetting a part of the third portion from the remainder of the third portion, and the offset part of the third portion including an aperture engaging said stud, the center of said aperture being on a plane passing through said second portion.

* * * * *